US005439176A

United States Patent [19]

Bussiere

[11] Patent Number: 5,439,176

[45] Date of Patent: Aug. 8, 1995

[54] LAWN-GARDEN SPRINKLER HAVING A TRIPOD SUPPORT STRUCTURE

[76] Inventor: Eugene Bussiere, 59 Beechwood Dr., Danville, N.H. 03819

[21] Appl. No.: 274,769

[22] Filed: Jul. 14, 1994

[51] Int. Cl.[6] ..... B05B 15/06

[52] U.S. Cl. ..... 239/276; 239/280; 248/85

[58] Field of Search ..... 239/275, 276, 280, 280.5, 239/281, 279; 248/85, 87, 156, 163.1

[56] References Cited

U.S. PATENT DOCUMENTS

| | | | |
|---|---|---|---|
| 807,184 | 12/1905 | Malnburg | 239/280.5 |
| 1,368,416 | 2/1921 | Thomas | 239/280 |
| 1,959,886 | 5/1934 | Wadsworth | 239/280.5 |
| 2,679,996 | 6/1954 | Rowe et al. | 248/156 |
| 2,694,600 | 11/1954 | Richey | 239/280 |
| 2,792,257 | 5/1957 | Davis | 248/85 |
| 4,339,880 | 7/1982 | Hall | 248/163.1 |
| 4,789,099 | 12/1988 | Hager | 239/281 |
| 4,824,020 | 4/1989 | Harward | 239/280 |

FOREIGN PATENT DOCUMENTS

| | | | |
|---|---|---|---|
| 1300332 | 8/1965 | Germany | 239/279 |

*Primary Examiner*—Andres Kashnikow
*Assistant Examiner*—Christopher G. Trainor
*Attorney, Agent, or Firm*—Frederick R. Cantor

[57] ABSTRACT

A rotary oscillating irrigation sprinkler head is supported in a stable elevated position above the ground surface, such that the sprinkler assembly can be used on a lawn or in garden foliage. A tripod support structure is connected at its upper end to a vertical water supply pipe that connects with the sprinkler head, so that the sprinkler head has a stabilized support above the ground surface. The water supply pipe delivers a pressurized stream of water to the sprinkler head.

6 Claims, 1 Drawing Sheet

LAWN-GARDEN SPRINKLER HAVING A TRIPOD SUPPORT STRUCTURE

BACKGROUND OF THE PRESENT INVENTION

1. Field of the Invention

The present invention relates to water sprinklers.

The present invention relates to rotary oscillatory water sprinklers.

The present invention relates, more particularly, to rotary oscillatory water sprinklers used for spraying water onto lawns or gardens, for irrigation purposes.

2. Prior Developments

An oscillating water sprinkler is often used for spraying water onto lawns for irrigation purposes. A typical oscillating water sprinkler can comprise a flat base seatable on the ground surface, and a rotary sprinkler head mounted on a spindle projecting upwardly from the base. The base has a threaded inlet fitting that is connectable to a standard garden hose, whereby a pressurized stream of water is supplied to the inlet fitting and the hollow spindle.

A spring-biased paddle is mounted on the spindle to pass across a nozzle opening in the rotary sprinkler head, such that water pressure forces are utilized to rotate the sprinkler head in a horizontal plane. Adjustable stops are provided on the stationary part of the sprinkler, to permit the sprinkler head to oscillate back and forth, or to rotate continuously in a single direction.

As the sprinkler head rotates in a horizontal plane, a pressurized stream of water is discharged through the nozzle opening in the sprinkler head at an inclination angle of about thirty degrees. The discharged stream of water has a divergent spray-like character, comprised of multiple water droplets that diverge from one another as the droplets move further away from the sprinkler head.

The divergent water spray has an arcuate trajectory, wherein gravitational forces cause the water droplets to be deposited on the target surface, i.e., lawn or other vegetation, at varying distances from the sprinkler. The rotary motion of the sprinkler head enables a specific target area to be covered with a relatively uniform water concentration across the target area.

However, the described conventional rotary oscillation sprinkler has some disadvantages or limitations. For instance, the sprinkler does not work very well when the vegetation has an appreciable height above the ground surface. If the sprinkler is placed on the ground in the vegetation area, the foliage near the sprinkler will obstruct the water stream before it can acquire the necessary divergence to provide a desired coverage of the target area.

If the sprinkler is placed in an unobstructed area the divergent spray of water discharged from the sprinkler head may not achieve a sufficient height to descend at an optimum angle onto the target vegetation. Vegetation protruding a significant distance upwardly from the ground surface may intercept some of the water droplets before such droplets can reach the ground surface. Further, the target area may not receive full water coverage.

SUMMARY OF THE PRESENT INVENTION

An object of the present invention is to provide a water sprinkler.

A further object of the present invention is to provide a rotary oscillatory water sprinkler.

Yet another object of the present invention is, more particularly, to provide a rotary oscillatory sprinkler, wherein the sprinkler head is elevated an appreciable distance from the ground surface. Typically the sprinkler head can be spaced above the ground surface by a distance of about forty inches.

By spacing the sprinkler head above the ground surface it becomes possible to effectively use the sprinkler in areas of high vegetation growth, i.e., areas containing flowers, or vegetables, growing to a height of about three feet. The growing vegetation is below the sprinkler head so that the water spray is unobstructed by the vegetation.

The elevated sprinkler head may also be advantageous in that the length of the water spray and the overall width of the water spray are somewhat increased. The increases are due to the fact that there is a greater vertical distance for the water droplets to travel during the motion of the droplets away from the sprinkler head.

In the preferred practice of the present invention, the sprinkler head is mounted on an essentially vertical water supply pipe that is affixed to the upper end of a supporting tripod. The tripod is preferably formed out of steel rod stock, wherein the rod diameters are relatively small, e.g., less than one-half inch. The tripod, defined by the steel rods, can be placed in relatively deep vegetation without causing significant injury to the vegetation. The lower ends of the relatively small diameter metal rods can be inserted into the earth surface so as to provide a stable support for the sprinkler head, without piercing or tearing the growing vegetation.

The lower end sections of the tripod support rods are preferably parallel to each other, such that the tripod can be anchored in the ground surface with the tripod axis slightly tilted. By tilting the tripod it becomes possible to change the arcuate trajectory of the water spray so as to slightly adjust the area being watered, e.g., to cover a particular group of flowers, or a particular shrub.

The tripod construction of the present invention is a relatively low cost structure, designed to provide a stable support for an elevated sprinkler head, such that the sprinkler can be used for spraying water on both lawns and garden areas, without adjusting, or modifying, the tripod support mechanism. A water supply pipe is built into the tripod mechanism, whereby the sprinkler can be supplied with a pressurized water supply, using conventional hoses, valves, timers, and feeder attachments.

In summary, and in accordance with the above discussion, the foregoing objectives are achieved in the following embodiments.

1. A lawn-garden sprinkler comprising:

a sprinkler head having a vertical spindle and a spray nozzle rotatably mounted on said spindle for rotation in a horizontal plane around said spindle axis;

means for supporting said sprinkler head at an elevated position above ground level;

said supporting means comprising a water supply pipe having an upper end connected to said hollow spindle, and a lower end spaced above the ground surface; and a tripod having an upper end connected to said water supply pipe so that the upper end of the water supply pipe constitutes a vertical extension of the hollow spindle.

2. The sprinkler, as described in paragraph 1, wherein said tripod comprises three support rods;

each support rod having an upper end connected to said water supply pipe, and a lower terminal end seatable on the ground surface; and the lower terminal ends of said support rods being located equidistant from the spindle axis.

3. The sprinkler, as described in paragraph 2, wherein said support rods have lower sections extending parallel to the spindle axis, to facilitate downward insertional movements of the rod terminal ends into the ground surface.

4. The sprinkler, as described in paragraph 2, wherein said tripod further comprises three horizontal tie rods extending between said support rods in a plane spaced above the rod terminal ends, to rigidify the tripod.

5. The sprinkler, as described in paragraph 2, wherein each support rod comprises an upright upper section diverging from the spindle axis in the downward direction, an intermediate horizontal section extending away from the spindle axis, and a lower section extending parallel to the spindle axis.

6. The sprinkler, as described in paragraph 5, wherein said tripod further comprises three horizontal tie rods extending between said support rods in a horizontal plane coincident with the horizontal sections of the support rods.

7. The sprinkler, as described in paragraph 1, wherein said water supply pipe comprises an upper section extending vertically on the spindle axis, and a lower section extending at an acute angle to said upper section;

said tripod comprising three support rods;

one of said support rods having an upper end connected to the lower section of said water supply pipe;

the other two support rods having upper ends connected to the upper section of said water supply pipe;

each support rod having a lower terminal end seatable on the ground surface; and the lower terminal ends of said support rods being located equidistant from the spindle axis.

8. The sprinkler, as described in paragraph 7, wherein said support rods have lower sections extending parallel to the spindle axis, to facilitate downward insertional movements of the rod terminal ends into the ground surface; and said tripod support rods being rigidly joined together remote from the rod terminal ends, whereby said support rods can be inserted into the ground surface such that the spindle axis has a non-vertical orientation.

A BRIEF DESCRIPTIONS OF THE DRAWINGS OF THE PRESENT INVENTION

DESCRIPTION OF THE PREFERRED EMBODIMENTS OF THE PRESENT INVENTION

Figure 1:
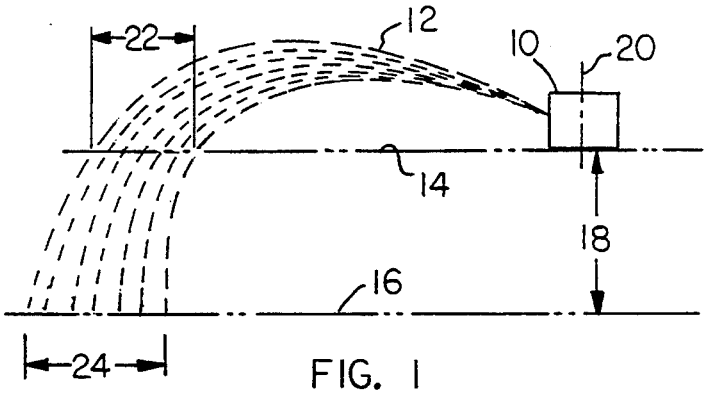
FIG. 1 is a diagrammatic representation of a water spray generated by a lawn-garden sprinkler device.

FIG. 1, is a diagrammatic representation of a water spray generated by a lawn-garden sprinkler device.

Referring now to FIG. 1, there is shown in diagrammatic fashion a sprinkler head 10 spraying a stream of water 12 in a right-to-left direction. The dashed lines in the water stream represent water droplets contained in the stream.

It will be noted that the water stream cross-section expands, or diverges, as the water droplets move away from sprinkler head 10. Some droplets may be split by aerodynamic forces while they are in the water stream, thereby promoting diffusion of the droplets. In general, the spacing between droplets increases as the stream moves away from the sprinkler head 10, such that a relatively large patch of ground or vegetation can be covered, with a small diameter sprinkler nozzle opening.

In FIG. 1, the sprinkler head 10 is shown resting on a horizontal surface 14 that represents the ground surface in a conventional sprinkler arrangement. A second horizontal line 16 is shown below the sprinkler head; this second horizontal line represents the ground surface, with the sprinkler head in an elevated position, i.e., with the sprinkler head spaced above the ground surface by a vertical distance 18. Line 16 is representative of the ground surface in a sprinkler arrangement according to the present invention.

The sprinkler head 10 includes a rotary nozzle adapted to rotate around a vertical axis 20, whereby the water spray covers an area centered on axis 20. With the sprinkler seated on ground surface 14, the zone covered by the water spray is related to dimension 22. With the sprinkler head 10 elevated above ground surface 16, the zone covered by the water spray is related to spray cross-sectional dimension 24.

It will be seen that when the sprinkler head 10 is elevated above the ground surface, the coverage area of the water stream is increased, i.e., dimension 24 is greater than dimension 22. Also, the vertical distance 18, somewhat lengthens the total travel distance for each water droplet, such that there is a greater chance that any given droplet will be split before it reaches the target surface (14 or 16). When the sprinkler head 10 is elevated above the ground surface, the water spray reaching the target surface, will tend to be a finer, more diffused, spray that provides a more uniform coverage of the target surface.

The elevated sprinkler head 10 is further advantageous in that the sprinkler head can be placed in a flower or vegetable bed, without having the foliage obstruct water flow out of the nozzle opening. Additionally, when the sprinkler head is elevated above the ground surface the droplets in the water stream reaching the target area tend to be falling in an essentially vertical direction; when the sprinkler head is located at ground level the water droplets tend to strike the target surface at an oblique angle (i.e., non-vertical). In some cases the vertical water droplet condition is advantageous, e.g. when the foliage is fragile, or when the foliage might prevent non-vertically moving droplets from reaching the ground surface.

FIG. 1 is intended to show that an elevated sprinkler head has some advantages not possessed by sprinkler heads located at ground level. The present invention is concerned with a support structure for supporting a rotary oscillating sprinkler head in an elevated position spaced above the ground surface.

Figure 2:
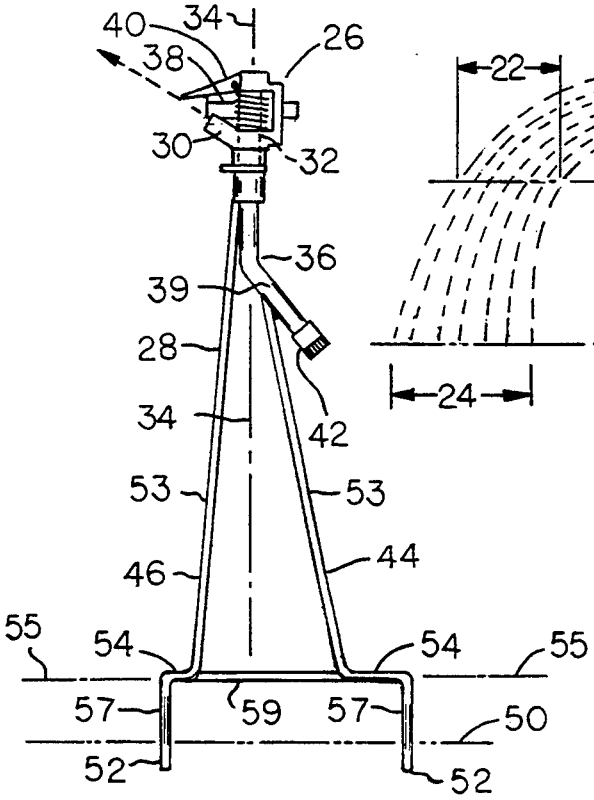
FIG. 2 is an elevational view, of a lawn-garden sprinkler assembly embodying the present invention.

FIG. 2, is an elevational view, of a lawn-garden sprinkler assembly embodying the present invention.

Figure 3:
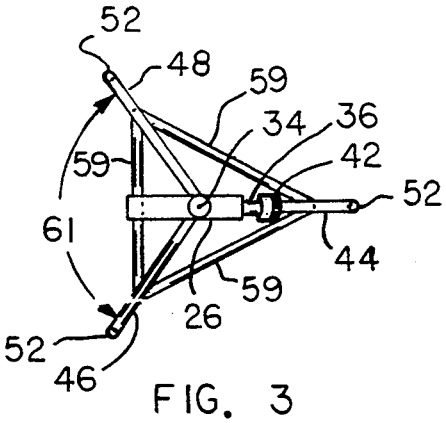
FIG. 3 is a top plan view, of the sprinkler assembly shown in FIG. 2.

FIG. 3, is a top plan view, of the sprinkler assembly shown in FIG. 2.

FIGS. 2 and 3 illustrate a preferred form of the present invention. FIGS. 2 and 3 show a conventional rotary oscillating sprinkler head 26, supported by a tripod support mechanism 28. The sprinkler head is preferably a known sprinkler construction offered by ORBITAL SPRINKLERS of BOUNTIFUL, UT 84010, under the tradename ORBIT. As diagrammatically shown in attached FIG. 2, the sprinkler head 26 comprises a rotary nozzle structure 30 mounted on a stationary upright spindle 32 for rotation around the spindle axis 34. The spindle 32 may be hollow to conduct pressurized water from a subjacent water supply pipe 36 to the nozzle opening.

A spring-biased paddle 38 can be rotatably mounted on spindle 32 to periodically intercept the water jet issuing from nozzle structure 30, whereby hydraulic reaction forces are used to rotate the nozzle structure in a horizontal plane around spindle axis 34. An adjustable deflector 40 can be provided to intercept the water spray at a slight angle, whereby the length of the spray stream is controlled to a certain extent. Adjustable stops are provided on the stationary portion of the sprinkler head 26 to control the arcuate stroke of the nozzle structure 30 in the horizontal rotational plane.

As noted above, the sprinkler head is of known construction. The present invention relates, more particularly, to water supply pipe 36 and tripod 28. The extreme upper end of water supply pipe 36 is internally threaded to receive an externally threaded pipe section of the sprinkler head 26, whereby the head is firmly affixed to water supply pipe 36.

The upper section of water supply pipe 36 extends generally vertically in axial alignment with the spindle axis 34, whereas the lower section 39 of the water supply pipe, extends at an acute angle to the pipe upper section; the angulation is preferably about forty degrees. At its lower end, the water supply pipe 36 has a swivel fitting 42 that is internally threaded to fit a male thread on the end of a conventional garden hose. Fitting 42 could also be used to connect the water supply pipe 36 to a shut-off valve, fertilizer feeder unit, or timer.

The angulation of pipe lower section 39 is primarily for the purpose of rigidly connecting the pipe to tripod 28 so that the pipe cannot flex, or break away from the tripod 28. The tripod comprises three steel support rods 44, 46 and 48. The three support rods are substantially similar to each other, except that rod 44 is somewhat shorter than the other two rods 46 and 48. Each support rod has an upper end thereof connected to water supply pipe 36 via welding.

The upper end of support rod 44 is joined to pipe 36 at an intermediate point along the length of angulated lower pipe section 39, whereas the upper ends of support rods 46 and 48 are joined to pipe 36 at a shoulder formed by the internally threaded connector at the upper end of the pipe. By connecting the tripod 28 to pipe 36 at spaced points along the pipe length, the pipe is rigidified against bending or deflecting, as might cause the pipe to break away from the support rods.

Each support rod 44, 46 or 48 can be a steel rod having a diameter of about three-eighth inch. Water pipe 36 can be a steel pipe having an internal diameter of about one-half inch. Rods 44, 46 and 48 are of sufficient length as to space the sprinkler head 26 an appreciable distance above the ground surface, designated by numeral 50 in FIG. 2. The preferred elevation distance is about forty inches, although beneficial results can be obtained with other elevational spacings.

The lower terminal ends 52 of the metal support rods can be sharpened to facilitate insertional movement of the support rod ends into the ground surface a slight distance, e.g., two inches, whereby the tripod 28 is stabilized against displacement, or tipping over, due to reaction forces associated with water discharge through the nozzle structure 30.

Each support rod 44, 46, or 48, comprises an upper rod section 53 that diverges away from spindle axis 34, and an intermediate horizontal section 54 extending in a common horizontal plane 55 spaced above the lower rod ends. The lower end section 57 of each support rod extends at right angles to the associated rod horizontal sections 54, such that the three rod sections 57 are parallel to each other. Such parallelism is advantageous in that it facilitates downward insertional movements of the rod ends 52 into the ground surface.

The three support rods 44, 46 and 48 are rigidly connected together by means of three horizontal tie rods 59 located in plane 55; the ends of the tie rods 59 are welded to the support rods to provide a rigid tripod construction resistant to fracture or bending forces.

The terminal ends 52 of the support rods are located equidistant from the central tripod axis (that is coincident with spindle axis 34), such that the sprinkler head 26 has a wide stance support for stability. The distance from central axis 34 to each rod end 52 is preferably at least about ten inches.

Support rods 44, 46 and 48 radiate outwardly from central axis 34, as viewed in FIG. 3. However, the circumferential spacing of the support rods is preferably not exactly uniform. The circumferential spacing 61 of support rods 46 and 48 is preferably about one hundred and ten degrees, whereas the circumferential spacing of support rod 44 relative to support rods 46 and 48 is preferably about one hundred and twenty-five degrees. Support rod 44 is in a common vertical plane with water supply pipe 36, as viewed in FIG. 3.

The sprinkler assembly can be supported on the ground surface, so that central axis 34 is vertical, as depicted in FIG. 2. However, it is possible to position the sprinkler assembly as tilted slightly from the vertical. Such tilting of the sprinkler assembly axis can be used to produce slight changes in the arcuate trajectory of the divergent water stream generated by the sprinkler head. The stream trajectory distance can thus be increased, or decreased, slightly to cover a specific foliage area, e.g. a particular bush or group of flowers.

The tilting action can be accomplished by sinking the terminal end of rod 44 into the ground surface a slightly greater (or a slightly lesser) distance than the terminal ends of the support rods 46 and 48.

The tripod support structure is utilized for the purpose of elevating the sprinkler head an appreciable distance above the ground surface, whereby the sprinkler assembly can be deployed on a lawn, or in a flower bed, without adjustments or changes in the tripod. The invention relates particularly to the construction of the tripod and the attached water supply pipe 36, whereby the sprinkler head has a stable elevated position above the ground surface.

The present invention described above, relates to a lawn-garden sprinkler having a tripod support structure. Features of the present invention are recited in the appended claims. The drawings contained herein necessarily depict structural features and embodiments of the lawn-garden sprinkler having a tripod support structure, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purpose of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A lawn-garden sprinkler comprising:

a sprinkler head having a hollow vertical spindle and a spray nozzle rotatably mounted on said spindle for rotation in a horizontal plane around the spindle axis;

means for supporting said sprinkler at an elevated position above ground level;

said supporting means comprising a water supply pipe having an upper end connected to said hollow spindle, and a lower end spaced above the ground surface;

a tripod having an upper end connected to said water supply pipe so that the upper end of the water supply pipe constitutes a vertical extension of the hollow spindle;

said water supply comprising an upper section extending vertically on the spindle axis, and a lower section at an acute angle to said upper section;

said tripod comprising three support rods;

one of said support rods having an upper end connected to the lower section of said water supply pipe, the other two support rods having upper ends connected to the upper section of said water supply pipe;

each support rod having a lower terminal end seatable on the ground surface; and the lower terminal ends of said support rods being located equidistant from the spindle axis.

2. The sprinkler, as described in claim 1, wherein said support rods have lower sections extending parallel to the spindle axis, to facilitate downward insertional movements of the rod terminal ends into the ground surface; and said tripod support rods being rigidly joined together remote from the rod terminal ends, whereby said support rods can be inserted into the ground surface so that the spindle axis has a non-vertical orientation.

3. A lawn-garden sprinkler comprising:

a sprinkler head having a hollow vertical spindle and a spray nozzle rotatably mounted on said spindle for rotation in a horizontal plane around the spindle axis;

means for supporting said sprinkler head at an elevated position above ground level;

said supporting means comprising an upright water supply pipe having an upper end connected to said spindle, and a lower end spaced above the ground surface;

a tripod having an upper end connected directly to said water supply pipe so that the upper end of the water supply pipe constitutes a vertical extension of the hollow spindle;

said water supply pipe comprising an upper section, and a lower section;

said tripod comprising three support rods;

one of said support rods having an upper end rigidly joined directly to the lower section of said water supply pipe, the other two support rods having upper ends rigidly joined directly to the upper section of said water supply pipe, whereby the support rods cooperatively resist dislocations of the water supply pipe from its upright position;

each support rod having a lower terminal end seatable on the ground surface; and the lower terminal ends of said support rods being located equidistant from the spindle axis.

4. The sprinkler, as described in claim 3, wherein said support rods have lower sections extending parallel to the spindle axis, to facilitate downward insertional movements of the rod terminal ends into the ground surface.

5. The sprinkler, as described in claim 3, wherein said support rods have lower sections extending parallel to the spindle axis, to facilitate downward insertional movements of the rod terminal ends into the ground surface; and said tripod further comprising three horizontal tie rods extending between said support rods in a plane spaced above the rod terminal ends, to rigidify the tripod.

6. The sprinkler, as described in claim 3, wherein each support rod comprises an upright upper section diverging from the spindle axis in the downward direction, an intermediate horizontal section extending away from the spindle axis, and a lower section extending parallel to the spindle axis; and an intermediate horizontal section extending away from the spindle axis, and a lower section extending parallel to the spindle axis; and said tripod further comprising horizontal tie rods extending between said support rods in a horizontal plane coincident with the horizontal sections of the support rods.

* * * * *